US011636975B2

(12) United States Patent
Fang et al.

(10) Patent No.: US 11,636,975 B2
(45) Date of Patent: Apr. 25, 2023

(54) DEVICE FOR PREPARING A MAGNETIC CORE WITH A THIN AMORPHOUS RIBBON

(71) Applicant: Zhejiang Normal University, Jinhua (CN)

(72) Inventors: Yunzhang Fang, Jinhua (CN); Wenzhong Li, Jinhua (CN); Zheng Fang, Jinhua (CN); Yun Ma, Jinhua (CN); Rimin Pan, Jinhua (CN); Huiqun Ye, Jinhua (CN); Jinju Zheng, Inhua (CN); Linfeng Jin, Jinhua (CN); Xiaozhen Fan, Jinhua (CN)

(73) Assignee: ZHEJIANG NORMAL UNIVERSITY, Jinhua (CN)

( * ) Notice: Subject to any disclaimer, the term of this patent is extended or adjusted under 35 U.S.C. 154(b) by 214 days.

(21) Appl. No.: 16/950,032

(22) Filed: Nov. 17, 2020

(65) Prior Publication Data

US 2022/0157518 A1 May 19, 2022

(30) Foreign Application Priority Data

Sep. 16, 2019 (CN) ..... 20120109824451

(51) Int. Cl.
*H01F 41/00* (2006.01)
*H01F 41/02* (2006.01)

(52) U.S. Cl.
CPC ..... *H01F 41/0226* (2013.01); *H01F 41/0246* (2013.01)

(58) Field of Classification Search
CPC ..... H01F 41/0226; H01F 41/0246; H01F 1/15341; H01F 1/15366
See application file for complete search history.

(56) References Cited

U.S. PATENT DOCUMENTS 4,945,339 A * 7/1990 Yamauchi ..... G08B 13/2442 148/307
7,511,679 B2 * 3/2009 Araki ..... G04G 21/04 343/788
7,905,966 B2 * 3/2011 Waeckerle ..... H01F 1/15333 148/540
9,343,210 B2 * 5/2016 Adar ..... H01F 3/04

* cited by examiner

*Primary Examiner* — Paul D Kim
(74) *Attorney, Agent, or Firm* — WPAT, PC

(57) ABSTRACT

The invention discloses a method and its device for preparing a magnetic core with amorphous ribbon. The magnetic core is prepared with amorphous ribbon, the size of the amorphous ribbon is controlled according to the target requirements, and the magnetic core with required size and shape is prepared according to the target requirements; the single-roller rapid quenching technology with online automatic segmentation and automatic storage capability is used for preparation, which can control the length, width and thickness of the amorphous ribbon according to the target requirements; the amorphous ribbon segmented by single-roller rapid quenching technology is used to spray and cool down one by one, and then air-dry, transfer, spray adhesive and online store it one by one; the stored amorphous ribbon is reshaped, compressed and heat-treated successively, and then demoulded to prepare a magnetic core.

6 Claims, 2 Drawing Sheets

DEVICE FOR PREPARING A MAGNETIC CORE WITH A THIN AMORPHOUS RIBBON

FIELD OF THE INVENTION

The invention relates to the field of magnetic core preparation technology, in particular to a method and its device for preparing a magnetic core with amorphous ribbon.

BACKGROUND OF THE INVENTION

The amorphous material has high saturation magnetic induction, high magnetic permeability, low coercivity and low losses, its excellent comprehensive properties, instead of permalloy, silicon steel and ferrite, are applied in the power electronic technology, show the characteristics of small volume, high efficiency and energy saving, etc. It has the optimal cost performance ratio among all metal soft magnetic materials, and it is one of the preferred materials for green energy saving in the future. In order to obtain the excellent properties and unique microstructure of the amorphous alloy, it is required to quench directly from the molten state to the temperature below the freezing point at an extremely high cooling rate during the preparation process. In order to meet the special requirements of rapid quenching process for amorphous alloy, single-roller rapid quenching technology is currently the most widely used technology to prepare an amorphous ribbon with a width of more than 1 cm. However, for amorphous ribbon with a width less than 1 mm, here is a severe involvement phenomenon, and it is difficult for the existing single-roller rapid quenching technology to realize the industrialization batch production of amorphous ribbon. The current commonly used technology for preparing amorphous filaments is the Rotating Water Spinning method. However, the Rotating Water Spinning method has the problems of low production efficiency and high production cost, and it is difficult to realize the industrialization application. Although the Taylor method can solve the problem of involvement between filaments through the method of on-line coiling, it needs to consume special cladding materials whose softening temperature matches the melting point of the alloy during the preparation process, and subsequent applications usually need to peel off the cladding materials. It can be seen that the Taylor method is also difficult to realize the industrialization application of magnetic core preparation due to its complex and difficult process, high production cost and low efficiency.

Therefore, the method and its device for preparing a magnetic core with amorphous ribbon in the existing technology have problems such as it is difficult to realize the industrialization batch preparation, complex and difficult process, low production efficiency and high cost, and filaments are easy to intertwine. There is no production line with amorphous filaments to prepare magnetic cores in the current technology, so it is impossible to achieve low-cost magnetic core production. In addition, the magnetic core prepared by amorphous ribbon can significantly improve the magnetic performance, reduce the eddy current losses and evidently improve the comprehensive efficiency of magnetic cores compared with the current magnetic core prepared by amorphous broadband.

Currently, similar patents that belong to the same technical field as the invention are as follows: The invention patent with the patent number of "CN201410162834.2" discloses an amorphous magnetic core, magnetic component and its method for preparing an amorphous magnetic core. Its innovative point lies in solving the problem that the folding stress of the coil is large when the flat wire is vertically wound on the magnetic core, which easily leads to the coil to bulge and the paint to peel off, thus affecting the reliability of the magnetic component using the magnetic core. In addition, the invention patent with the patent number of "CN201310682543.1" discloses a magnetic core preparation method. Its innovative point lies in that it starts from the composition design, smelting link and heat treatment link in the process of strip preparation process to prepare a good quality amorphous strip, and on this basis, the ferromagnetic core rolled by the strip is subjected to transverse magnetic field heat treatment, so as to obtain an inductance magnetic core with constant magnetic conductivity. The above two invention patents still cannot be used for the large-scale production of amorphous ribbons below 1 mm, and the production efficiency of the preparation of amorphous ribbon magnetic cores is low, and the industrialization batch preparation cannot be realized.

SUMMARY OF THE INVENTION

The purpose of the invention is to provide a method and its device for preparing a magnetic core with amorphous ribbon, so as to solve the technical problems existing in the above existing technology.

In order to achieve the above purpose, the invention provides the following solutions: The invention provides a method for preparing a magnetic core with amorphous ribbon. The magnetic core is prepared with amorphous ribbon, the size of the amorphous ribbon is controlled according to the target requirements, and the magnetic core with required size and shape is prepared according to the target requirements.

Preferably, the single-roller rapid quenching technology with online automatic segmentation and automatic storage capability is used for preparation, which can control the length, width and thickness of the amorphous ribbon accurately according to the target requirements.

Preferably, the amorphous ribbon segmented by single-roller rapid quenching technology is used to spray and cool down one by one, and then air-dry, transfer, spray adhesive and online store it one by one.

Preferably, the stored amorphous ribbon is reshaped, compressed and heat-treated successively, and then demoulded to prepare a magnetic core.

A device for preparing a magnetic core with amorphous ribbon, which comprises a single-roller rapid quenching mechanism, and the output end of the single-roller rapid quenching mechanism is provided with a material collecting mechanism, the material collecting mechanism comprises an inclined material collecting plate, a cooling liquid sprinkler head is provided above the material collecting plate, and a cooling liquid recovery pool is provided below the material collecting plate; the side plates are provided on the sides of the material collecting plate, and the two side plates provided on both sides of the material collecting plate repeat relative movement back and forth in the direction perpendicular to the transmission direction of the amorphous ribbon in the transmission process of the amorphous ribbon, so as to play an uniform role on the amorphous ribbon in the transmission process.

The material collecting plate is provided with a plurality of fumaroles, the fumaroles are connected with an air pump by a pipeline, and the air pump provides high-pressure gas for the fumaroles;

The output end of the material collecting plate is provided with a guide roller, the end of the guide roller far away from the material collecting plate is provided with two symmetrically provided splints, between the two splints and the material collecting plate is provided with an amorphous ribbon guide slide rail, and the end of the two splints far away from the guide roller is connected with a processing conveyor belt, the processing conveyor belt is connected with a feeding conveyor belt, the feeding conveyor belt is located at the bottom of the splints, and the processing conveyor belt and the feeding conveyor belt are provided with a material collecting box; the two symmetrically provided splints repeat movement back and forth in the process of the amorphous ribbon being stored into the material collecting box, and the amorphous ribbon falling the material collecting box is uniformed.

Preferably, the cooling liquid recovery pool is connected with a pressure pump by a pipeline, and the pressure pump is connected with a cooling liquid sprinkler head by a pipeline.

Preferably, a transfer conveyor belt is connected between the feeding conveyor belt and the processing conveyor belt;

The output end of the feeding conveyor belt is provided with a first lifting platform, the first lifting platform and the two splints are provided up and bottom correspondingly, and a second lifting platform is provided between the output end of the processing conveyor belt and the input end of the transfer conveying belt;

Preferably, a mould cavity is provided in the material collecting box, an adhesive spraying head is provided above the mould cavity, and the adhesive spraying head is correspondingly provided with the first lifting platform; the adhesive spraying head sprays the amorphous ribbon falling into the mould cavity layer by layer; the length of the mould cavity is consistent with the length of the amorphous ribbon falling into the mould cavity, and the amorphous ribbon falling into the mould cavity is uniformed in the storage process by the relative clamping movement of two splints.

Preferably, the first lifting platform comprises a first hydraulic cylinder, the piston end of the first hydraulic cylinder is fixed with a first connecting rod, the first connecting rod is axially connected with a first platform by a shaft lever, and the shaft lever is connected with an output shaft of the motor;

The second lifting platform comprises a second hydraulic cylinder, the piston end of the second hydraulic cylinder is fixed with a second connecting rod, and the second connecting rod is fixed with a second platform.

Preferably, the processing conveyor belt is provided with a pressing device and a heating device, the mould cavity in the material collecting box stores enough amorphous ribbon according to the target requirements after being reshaped and compressed by the pressing device, and the processed conveyor belt is conveyed to the heating device for heat treatment; the amorphous ribbon in the mould cavity after heat treatment is conveyed by the processing conveyor belt to the second platform in the second lifting platform for demoulding to obtain a magnetic core.

The invention discloses the following technical effects: Compared with the existing technology, the invention has the advantages of high production efficiency and low cost. The existing technology for preparing amorphous filaments or ribbons can not be used for cyclic continuous production. Moreover, it requires to sort out and settle cumbersome and time-consuming follow-up procedures such as intertwining, with low output and high cost. The invention can realize the pipelined continuous production from the preparation of amorphous ribbons to the preparation of magnetic cores, forming a set of full-chain pipeline with batch production capacity of amorphous ribbon magnetic cores, without tedious and time-consuming delay, which greatly improves the production efficiency, reduces the production cost, and obviously enhances the product performance.

BRIEF DESCRIPTION OF THE DRAWINGS

In order to more clearly explain the embodiments of the invention or the technical solutions in the existing technology, the following will give a brief introduction to the drawings required in the embodiments. It is obvious that the drawings in the following description are only some embodiments of the invention. For those ordinary technical personnel in the field, without paying any creative work, they can also obtain other drawings according to these drawings.

Of which, 1 is amorphous ribbon, 2 is material collecting plate, 3 is side plate, 4 is cooling liquid sprinkler head, 5 is cooling liquid recovery pool, 6 is fumarole, 7 is air pump, 8 is guide roller, 9 is splint, 10 is processing conveyor belt, 11 is feeding conveyor belt, 12 is material collecting box, 13 is pressure pump, 14 is transfer conveyor belt, 15 is heating device, 16 is adhesive spraying head, 17 is first hydraulic cylinder, 18 is first connecting rod, 19 is first platform, 20 is motor, 21 is second hydraulic cylinder, 22 is second connecting rod, 23 is second platform, 24 is mould cavity, 25 is melting crucible, 26 is molten mass tundish, 27 is radio-frequency induction coil, 28 is molten mass nozzle, 29 is rapid quenching cooling roller, 30 is groove, 31 is pressing device, 32 is amorphous ribbon guide slide rail.

DETAILED DESCRIPTION OF THE INVENTION

In the following part, the technical solutions in the embodiments of the invention will be described clearly and completely in conjunction with the drawings in the embodiments of the invention. Obviously, the described embodiments are only a part of the embodiments of the invention, not all of the embodiments. In view of the embodiments in the invention, all other embodiments obtained by those ordinary technical personnel in this field without paying any creative work belong to the scope of protection of the invention.

In order to make the above purpose, characteristics and advantages of the invention more obvious and understandable, the invention will be further illustrated in detail in conjunction with the drawings and specific implementation methods.

Embodiment 1

Figure 1:
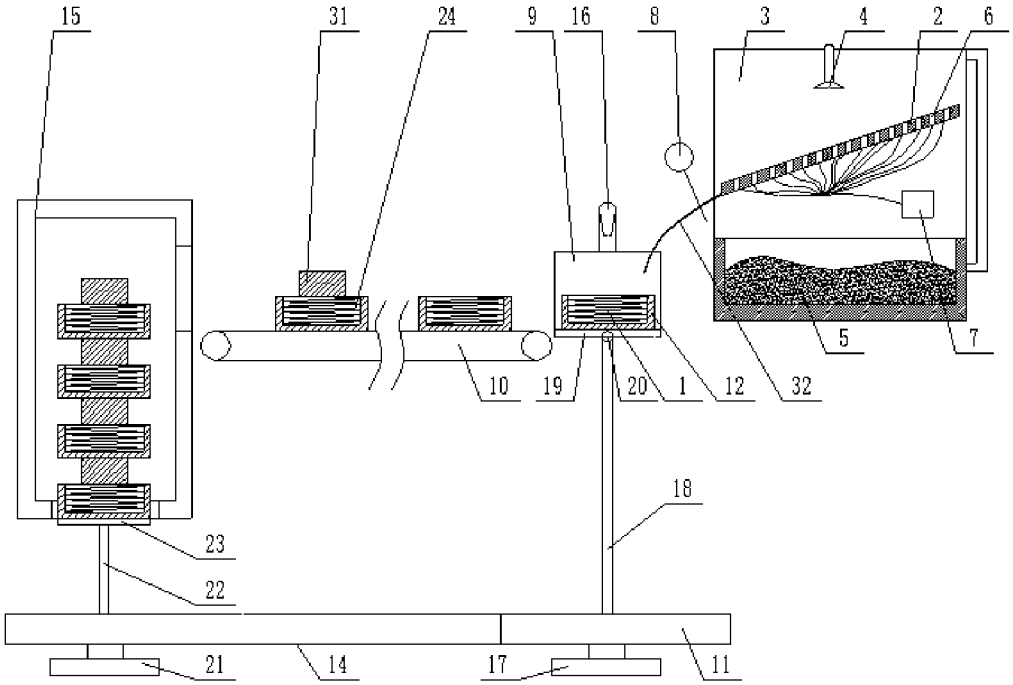
FIG. 1 is a front view of the device for preparing a magnetic core with amorphous ribbon of the invention.
Figure 2:
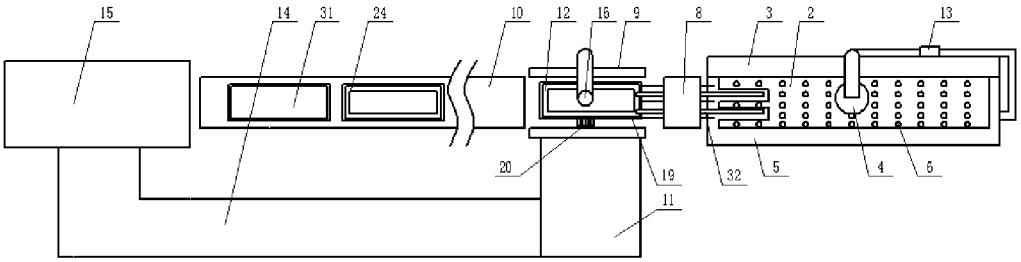
FIG. 2 is a top view of the device for preparing a magnetic core with amorphous ribbon of the invention.

Referring to FIGS. 1-2, the invention provides a method for preparing a magnetic core with amorphous ribbon. The magnetic core is prepared with amorphous ribbon 1, the size of the amorphous ribbon 1 is controlled according to the target requirements, and the magnetic core with required size and shape is prepared according to the target requirements.

Of which, the single-roller rapid quenching technology with online automatic segmentation and automatic storage capability is used for preparation, which can control the length, width and thickness of the amorphous ribbon 1 accurately according to the target requirements.

The amorphous ribbon 1 segmented by single-roller rapid quenching technology is used to spray and cool down one by one, and then air-dry, transfer, spray adhesive and online store it one by one.

The stored amorphous ribbon 1 is reshaped, compressed and heat-treated successively, and then demoulded to prepare a magnetic core.

A device for preparing a magnetic core with amorphous ribbon, which comprises a single-roller rapid quenching mechanism, the single-roller rapid quenching mechanism here has online automatic segmentation and conveying functions, and the output end of the single-roller rapid quenching mechanism is provided with a material collecting mechanism, the material collecting mechanism comprises an inclined material collecting plate 2, which conveys the segmented amorphous ribbon 1 to the material collecting plate 2, a cooling liquid sprinkler head 4 is provided above the material collecting plate 2, and a cooling liquid recovery pool 5 is provided below the material collecting plate 2, the amorphous ribbon 1 on the material collecting plate 2 is sprayed and cooled by the cooling liquid sprinkler head 4, and the cooling water flows into the cooling liquid recovery pool 5; the side plates 3 are provided on the sides of the material collecting plate 2, and the two side plates 3 provided on both sides of the material collecting plate 2 repeat relative movement back and forth in the direction perpendicular to the transmission direction of the amorphous ribbon in the transmission process of the amorphous ribbon, so as to play an uniform role on the amorphous ribbon in the transmission process.

The material collecting plate 2 is provided with a plurality of fumaroles 6, the fumaroles 6 are connected with an air pump 7 by a pipeline, and the air pump 7 provides high-pressure gas for the fumaroles 6; the air supply quantity of the fumaroles 6 at the input end of the material collecting plate 2 is larger than that of the fumaroles 6 at the output end, which makes the amorphous ribbon 1 quickly fall between the two splints 9 by the guide roller 8;

The output end of the material collecting plate 2 is provided with a guide roller 8, the end of the guide roller 8 far away from the material collecting plate 2 is provided with two symmetrically provided splints 9, between the two splints 9 and the material collecting plate 2 is provided with an amorphous ribbon guide slide rail 32, and the end of the two splints 9 far away from the guide roller 8 is connected with a processing conveyor belt 10, the processing conveyor belt 10 is connected with a feeding conveyor belt 11, the feeding conveyor belt 11 is located at the bottom of the splints 9, and the processing conveyor belt 10 and the feeding conveyor belt 11 are provided with a material collecting box 12, the two symmetrically provided splints 9 repeat movement back and forth in the process of the amorphous ribbon 1 being stored into the material collecting box 12, and the amorphous ribbon 1 falling the material collecting box 12 is uniformed.

The cooling liquid recovery pool 5 is connected with a pressure pump 13 by a pipeline, and the pressure pump 13 is connected with a cooling liquid sprinkler head 4 by a pipeline, the cooling liquid sprayed from the cooling liquid sprinkler head 4 is collected by the cooling liquid recovery pool 5, and the cooling liquid in the pool is pumped to the cooling liquid sprinkler head 4 by the pressure pump 13 to form a circulating spray cooling.

A transfer conveyor belt 14 is connected between the feeding conveyor belt 11 and the processing conveyor belt 10; the transfer conveyor belt 14 is responsible for conveying the material collecting box 12 demoulded at the output end of processing conveyor belt 10 to the feeding conveyor belt 11 to form a cyclic feeding.

The output end of the feeding conveyor belt 11 is provided with a first lifting platform, the first lifting platform and the two splints 9 are provided up and bottom correspondingly, and a second lifting platform is provided between the output end of the processing conveyor belt 10 and the input end of the transfer conveying belt 14, the feeding conveyor belt 11 conveys the material collecting box 12 to the first lifting platform one by one, and brings it between the two splints 9 by the first lifting platform, and the material collecting box 12 output from the output end of the processing conveyor belt 10 is sent to the second lifting platform for demoulding, and the second lifting platform drives it to fall, so that it is on the transfer conveyor belt 14, and the empty material collecting box 12 is conveyed to the feeding conveyor belt 11;

A mould cavity 24 is provided in the material collecting box 12, an adhesive spraying head 16 is provided above the mould cavity 24, and the adhesive spraying head 16 is correspondingly provided with the first lifting platform; the adhesive spraying head 16 sprays the amorphous ribbon 1 falling into the mould cavity 24 layer by layer; the length of the mould cavity 24 is consistent with the length of the amorphous ribbon 1 falling into the mould cavity, and the amorphous ribbon 1 falling into the mould cavity 24 is uniformed in the storage process by the relative clamping movement of two splints 9.

The first lifting platform comprises a first hydraulic cylinder 17, the piston end of the first hydraulic cylinder 17 is fixed with a first connecting rod 18, the first connecting rod 18 is axially connected with a first platform 19 by a shaft lever, and the shaft lever is connected with an output shaft of the motor 20, the first connecting rod 18 is driven up and down by the first hydraulic cylinder 17, which can control the height of the first platform 19, and the motor 20 can control the first platform 19 to flip to both sides so as to form a certain tilt angle, which is conducive to the material collecting box 12 sliding onto the processing conveyor belt 10;

The second lifting platform comprises a second hydraulic cylinder 21, the piston end of the second hydraulic cylinder 21 is fixed with a second connecting rod 22, and the second connecting rod 22 is fixed with a second platform 23, the second connecting rod 22 is driven up and down by the second hydraulic cylinder 21, which can control the height of the second platform 23.

The processing conveyor belt 10 is provided with a pressing device 31 and a heating device 15, the mould cavity 24 in the material collecting box 12 stores enough amorphous ribbon 1 according to the target requirements after being reshaped and compressed by the pressing device 31, and the processed conveyor belt 10 is conveyed to the heating device 15 for heat treatment; the amorphous ribbon 1 in the mould cavity 24 after heat treatment is conveyed by the processing conveyor belt 10 to the second platform 23 in the second lifting platform for demoulding to obtain a magnetic core.

The size of the material collecting box 12 is not greater than the distance between the two splints 9, the material collecting box 12 is provided with a mould cavity 24, and the amorphous ribbon 1 is stacked in the mould cavity 24 when it is stored.

Embodiment 2

Figure 3:
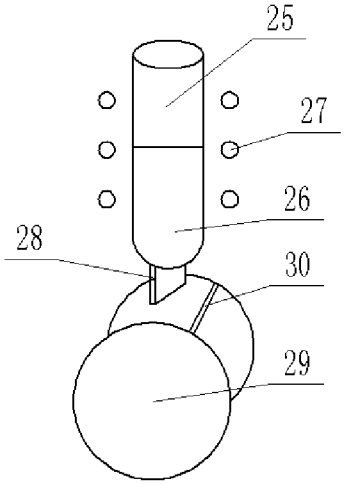
FIG. 3 is a structure diagram of the single-roller rapid quenching mechanism in Embodiment 2.

Referring to FIG. 3, the single-roller rapid quenching mechanism in the invention comprises a melting crucible 25, a molten mass tundish 26 is provided at the bottom of the melting crucible 25, an radio-frequency induction coil 27 is provided on the outside of the pipe wall of the molten mass tundish 26 and the melting crucible 25, the bottom end of the molten mass tundish 26 is provided with a molten mass nozzle 28, and a rapid quenching cooling roller 29 is provided below the molten mass nozzle 28, and at least one groove 30 is provided on the rapid quenching cooling roller 29, and the length of groove 30 is 1.2 times of that of molten mass nozzle 28; the width of groove 30 is 0.1-0.3 mm, and the depth is 0.1-0.35 mm. The molten mass nozzle 28 is provided with a plurality of spray holes, the diameter of the spray holes is 0.1-1 mm, the number of the spray holes is 1-100, and the nozzle spacing is 0.1-1.5 mm. The molten mass is heated by the melting crucible 25 to drop into the molten mass tundish 26 for storage, and it is continuously heated and kept warm by radio-frequency induction coil 27. When the molten mass is sprayed to the rapid quenching cooling roller 29 by the molten mass nozzle 28, it is rapidly quenched to form an amorphous ribbon, which is automatically separated at the groove 30 to form a segmented amorphous ribbon 1. The segmented amorphous ribbon 1 is thrown toward the material collecting plate 2 under the action of the centrifugal force formed by the high-speed rotation of the cooling roller, after spray cooling, it is conveyed to the material collecting box 12 by any conveying device.

In the description of the invention, it should be understood that the directions or positional relations indicated by the terms "Longitudinal", "Horizontal", "Up", "Down", "Front", "Rear", "Left", "Right", "Vertical", "Horizontal", "Top", "Bottom", "Inside", "Outside" are based on the directions or positional relations shown in the drawings, which is only for the convenience of describing the invention, rather than indicating or implying that the device or element referred to must have a specific orientation, be constructed and operated in a specific orientation, therefore, it cannot be understood as a limitation of the invention.

The above described embodiments are only to describe the preferred methods of the invention, but not to limit the scope of the invention. On the premise of not departing from the design spirit of the invention, various deformations and improvements made by those ordinary technical personnel in the field to the technical solutions of the invention shall fall within the protection scope determined by the claims of the invention.

The invention claimed is:

1. A device for preparing a magnetic core with a thin amorphous ribbon, which comprises a single-roller rapid quenching mechanism, and wherein an output end of the single-roller rapid quenching mechanism is provided with a material collecting mechanism, the material collecting mechanism comprises an inclined material collecting plate (2), a cooling liquid sprinkler head (4) is provided above the material collecting plate (2), and a cooling liquid recovery pool (5) is provided below the material collecting plate (2); side plates (3) are provided on sides of the material collecting plate (2), and two of the side plates (3) provided on both sides of the material collecting plate (2) repeat relative movement back and forth in a direction perpendicular to a transmission direction of the thin amorphous ribbon in a transmission process of the thin amorphous ribbon, so as to play an uniform role on the thin amorphous ribbon in the transmission process, wherein the material collecting plate (2) is provided with a plurality of fumaroles (6), the fumaroles (6) are connected with an air pump (7) by a pipeline, and the air pump (7) provides high-pressure gas for the fumaroles (6), wherein an output end of the material collecting plate (2) is provided with a guide roller (8), an end of the guide roller (8) far away from the material collecting plate (2) is provided with two symmetrically provided splints (9), between the two splints (9) and the material collecting plate (2) is provided with a thin amorphous ribbon guide slide rail (32), and ends of the two splints (9) far away from the guide roller (8) is connected with a processing conveyor belt (10), the processing conveyor belt (10) is connected with a feeding conveyor belt (11), the feeding conveyor belt (11) is located at bottoms of the splints (9), and the processing conveyor belt (10) and the feeding conveyor belt (11) are provided with a material collecting box (12); the two symmetrically provided splints (9) repeat movement back and forth in the process of the thin amorphous ribbon (1) being stored into the material collecting box (12), and the thin amorphous ribbon (1) falling the material collecting box (12) is uniformed.

2. The device for preparing the magnetic core with the thin amorphous ribbon as described in claim 1, wherein the cooling liquid recovery pool (5) is connected with a pressure pump (13) by a pipeline, and the pressure pump (13) is connected with the cooling liquid sprinkler head (4) by a pipeline.

3. The device for preparing the magnetic core with the thin amorphous ribbon as described in claim 1, wherein a transfer conveyor belt (14) is connected between the feeding conveyor belt (11) and the processing conveyor belt (10), and wherein an output end of the feeding conveyor belt (11) is provided with a first lifting platform, the first lifting platform and the two splints (9) are provided up and bottom correspondingly, and a second lifting platform is provided between an output end of the processing conveyor belt (10) and an input end of the transfer conveying belt (14).

4. The device for preparing the magnetic core with the thin amorphous ribbon as described in claim 3, wherein a mould cavity (24) is provided in the material collecting box (12), an adhesive spraying head (16) is provided above the mould cavity (24), and the adhesive spraying head (16) is correspondingly provided with the first lifting platform; the adhesive spraying head (16) sprays the thin amorphous ribbon (1) falling into the mould cavity (24) layer by layer; a length of the mould cavity (24) is consistent with a length of the thin amorphous ribbon (1) falling into the mould cavity (24), and the thin amorphous ribbon (1) falling into the mould cavity (24) is uniformed in the storage process by the relative clamping movement of the two splints (9).

5. The device for preparing the magnetic core with the thin amorphous ribbon as described in claim 3, wherein the first lifting platform comprises a first hydraulic cylinder (17), a piston end of the first hydraulic cylinder (17) is fixed with a first connecting rod (18), the first connecting rod (18) is axially connected with a first platform (19) by a shaft lever, and the shaft lever is connected with an output shaft of the motor (20);

wherein the second lifting platform comprises a second hydraulic cylinder (21), a piston end of the second hydraulic cylinder (21) is fixed with a second connecting rod (22), and the second connecting rod (22) is fixed with a second platform (23).

6. The device for preparing the magnetic core with the thin amorphous ribbon as described in claim 5, wherein the processing conveyor belt (10) is provided with a pressing device (31) and a heating device (15), the mould cavity (24) in the material collecting box (12) stores enough the thin amorphous ribbon (1) according to target requirements after being reshaped and compressed by the pressing device (31), and the processed conveyor belt (10) is conveyed to the heating device (15) for a heat treatment; the thin amorphous ribbon (1) in the mould cavity (24) after the heat treatment is conveyed by the processing conveyor belt (10) to the second platform (23) in the second lifting platform for demoulding to obtain the magnetic core.

* * * * *